US009486087B2

(12) United States Patent
Corbett

(10) Patent No.: US 9,486,087 B2
(45) Date of Patent: Nov. 8, 2016

(54) NONSLIP SEAT PAD

(71) Applicant: Daniel Keith Corbett, Brantford (CA)

(72) Inventor: Daniel Keith Corbett, Brantford (CA)

( * ) Notice: Subject to any disclaimer, the term of this patent is extended or adjusted under 35 U.S.C. 154(b) by 0 days.

(21) Appl. No.: 13/987,498

(22) Filed: Aug. 1, 2013

(65) Prior Publication Data

US 2014/0070580 A1 Mar. 13, 2014

Related U.S. Application Data

(60) Provisional application No. 61/742,170, filed on Aug. 6, 2012, provisional application No. 61/742,169, filed on Aug. 6, 2012, provisional application No. 61/742,171, filed on Aug. 6, 2012.

(51) Int. Cl.

| | |
|---|---|
| ***A47D 15/00*** | (2006.01) |
| ***A61G 5/10*** | (2006.01) |
| *A47C 7/02* | (2006.01) |

(52) U.S. Cl.

CPC ..... *A47D 15/005* (2013.01); *A61G 5/1043* (2013.01); *A47C 7/021* (2013.01)

(58) Field of Classification Search

CPC ..... A47D 15/005
USPC ..... 297/219.12, 223, 256.17; D6/601
See application file for complete search history.

(56) References Cited

U.S. PATENT DOCUMENTS

| | | | | |
|---|---|---|---|---|
| 570,033 | A * | 10/1896 | Machold | 297/214 |
| 1,205,384 | A * | 11/1916 | Peck | 297/228.12 |
| 5,310,245 | A * | 5/1994 | Lyszczasz | 297/219.12 |
| 5,346,278 | A * | 9/1994 | Dehondt | 297/219.1 |
| D354,349 | S * | 1/1995 | Grein | D24/124 |
| 5,471,690 | A * | 12/1995 | McNeil | 5/644 |
| 5,675,853 | A * | 10/1997 | Linge | 5/655 |
| 5,842,739 | A * | 12/1998 | Noble | 297/219.12 |
| 6,266,832 | B1 * | 7/2001 | Ezell | 5/640 |
| 6,905,169 | B1 * | 6/2005 | Donoghue | 297/250.1 |
| 6,959,963 | B2 * | 11/2005 | Hunter et al. | 297/219.12 |
| 6,988,771 | B1 * | 1/2006 | Huang | 297/219.1 |
| D540,097 | S * | 4/2007 | Gebbia | D6/601 |
| 7,252,330 | B2 * | 8/2007 | Lincoln | 297/219.12 |
| 7,481,491 | B1 * | 1/2009 | Diamantis | 297/223 |
| 8,075,464 | B2 * | 12/2011 | Hayes | A63B 6/00 482/140 |
| 2005/0264055 | A1 * | 12/2005 | Lincoln | 297/219.12 |
| 2007/0057562 | A1 * | 3/2007 | Gregory | A47C 7/022 297/452.21 |
| 2009/0096260 | A1 * | 4/2009 | Long et al. | 297/219.12 |
| 2010/0066138 | A1 * | 3/2010 | Rumack | 297/219.12 |
| 2011/0012405 | A1 * | 1/2011 | Conforti | 297/223 |
| 2013/0057033 | A1 * | 3/2013 | Conforti | 297/188.01 |
| 2013/0229036 | A1 * | 9/2013 | Bill et al. | 297/188.2 |

* cited by examiner

*Primary Examiner* — David E Allred
(74) *Attorney, Agent, or Firm* — Kathleen E. Marsman; Borden Ladner Gervais LLP

(57) ABSTRACT

The nonslip seat pad described herein is designed of nonslip material and is intended to stop a seated subject, such as an infant or child, from slipping, sliding and slouching into an unsafe position. The nonslip seat pad may be used during the toddler's years while feeding and playing. The nonslip seat pad may have a bum (buttocks) shape for a custom designed fit. The nonslip seat pad is made from a material that is versatile and mobile for the consumer and user's convenience.

4 Claims, 6 Drawing Sheets

NONSLIP SEAT PAD

CROSS-REFERENCE TO RELATED APPLICATION

This application claims the benefit of U.S. Provisional Application No. 61/742,170 filed Aug. 6, 2012, U.S. Provisional Application No. 61/742,171, filed Aug. 6, 2012, and U.S. Provisional Application No. 61/742,169, filed Aug. 6, 2012, all of which are incorporated herein by reference.

DETAILED DESCRIPTION

According to one embodiment, the nonslip seat pad may be made of a flat solid grey nonslip 3943/1460 material with grip that is provided in bun form then sliced into sheets of 42"×52" at 3/32 in thickness. The material is then cut into a custom shape and screen printed for identification.

According to one embodiment, the nonslip seat pad size is six inches in width and eight inches in length and three thirty seconds of an inch in thickness that is cut into bum (buttock) shape for a more custom design fit. The nonslip material is also versatile and mobile for the consumer and user's convenience.

The nonslip material was is designed to stop a subject, such as an infant or a child, from slipping, sliding and slouching into an unsafe position, for example during the toddler years, while feeding and playing. The slipping and sliding is caused by upper body weight and slippery surfaces that causes the subject such as an infant or child to slip and slide into an unsafe slouch position.

The nonslip seat pad is placed beneath the subject's buttocks, and may be used on a seat, such as the seats of chairs, highchairs, strollers, walkers, car seats, car boosters, super swings, teeter totters, spring toys, swings, wagons, pull toys.

The nonslip seat pad may help keep the infant or child in an upright position and reduce the chance of the infant choking on food or drink in a slouch position.

The nonslip seat pad may help correct an infant's or child's posture at an early stage in life.

The nonslip seat pad may help keep the subject such as an infant or child up in an upright position and may reduce the need for over-tightening of a restraint system that may cause indentation marks on the stomach area.

Figure 1:
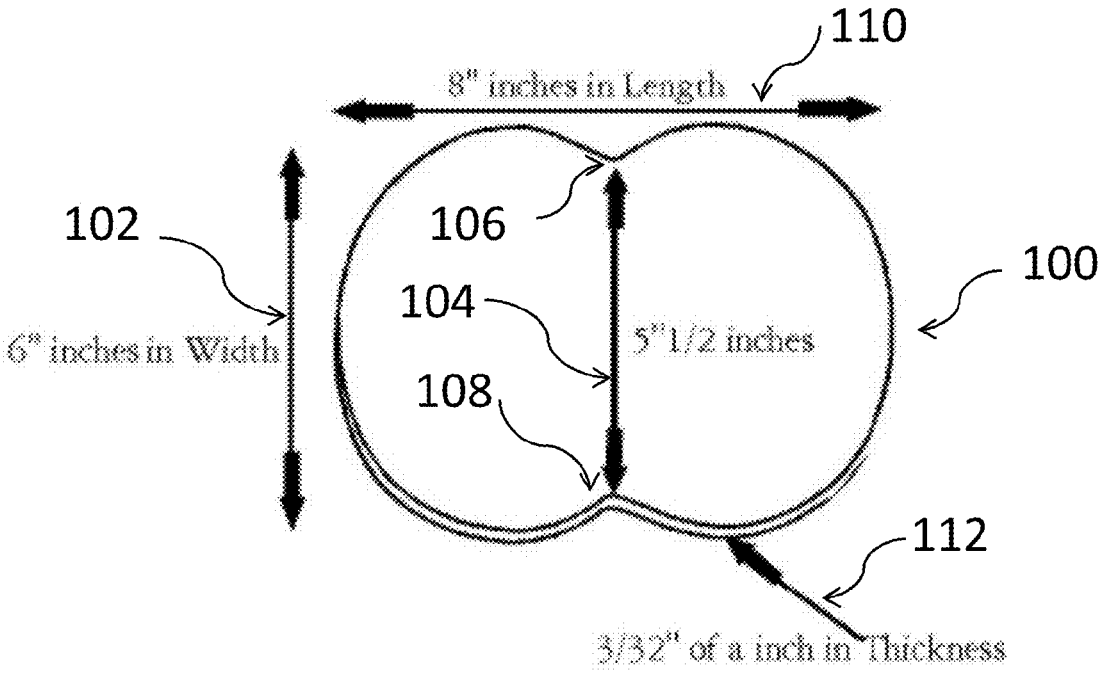
FIG. 1 illustrates the size, shape and dimension of a an embodiment of the nonslip seat pad.

FIG. 1 illustrates the size, shape and dimension of a an embodiment of the nonslip seat pad (100). The nonslip seat pad (100) is shown as 6 inches in width (102) with an indented portion (104) of 5½ inches to form a waist extending between two central indentations (106, 108) along both longitudinal edges, 8 inches in length (110) and 3/32 inches in thickness (112).

Figure 2:
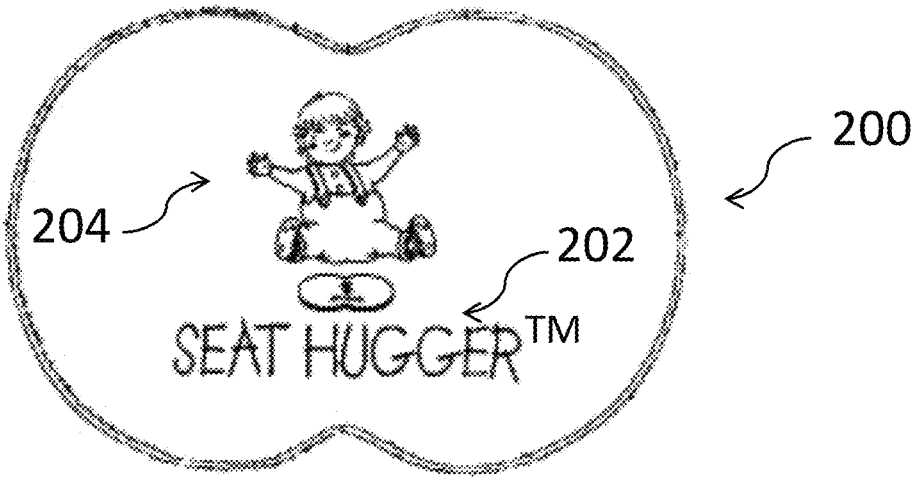
FIG. 2 illustrates a screen print applied to the material.

FIG. 2 illustrates a nonslip seat pad (200) bearing the Baby Hugger™ logo (202). The logo may be screen printed onto a surface of the nonslip seat pad, and may be present alone or in combination with an image, such as the image of an infant (204) positioned with buttocks located approximately above a nonslip seat pad to depict appropriate positioning for use. The nonslip seat pad may be formed of grey 3943/1460 material.

Figure 3:
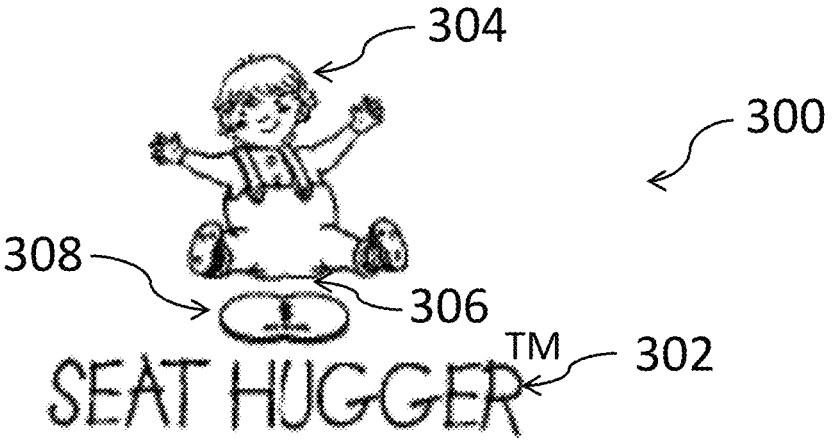
FIG. 3 illustrates an exemplary Baby Seat Hugger™ logo.

FIG. 3 illustrates the an exemplary combination (300) of a Baby Seat Hugger™ logo (302) together with an image of an infant (304) positioned with buttocks (306) located approximately above a depiction of a nonslip seat pad (308).

Figure 4:
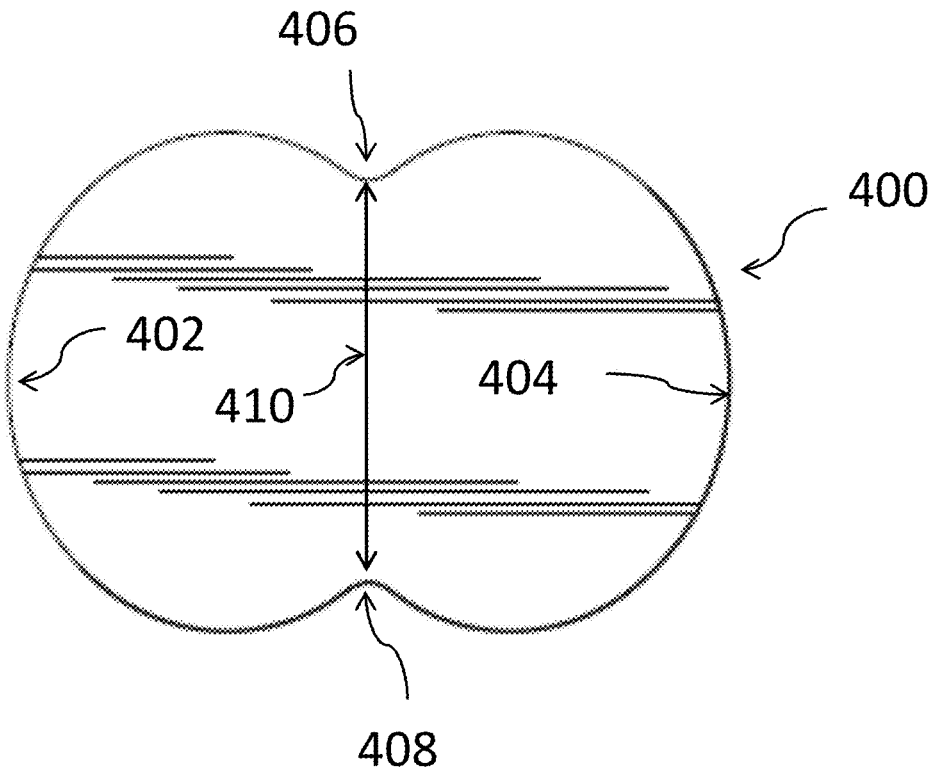
FIG. 4 illustrates an embodiment of the nonslip seat pad.

FIG. 4 illustrates a planar view of an embodiment of the nonslip seat pad, showing an exemplary shape (400) into which sheets of a gripping nonslip material may be cut. The shape (400) may be the shape of seated buttocks, comprising an oval extending longitudinally between opposing ends (402, 404), whereby the oval shape is interrupted by central indentations (406, 408), one formed along each longitudinal edge of the oval, to form a waist (410). The material may, for example, consist of 3943/1460 material. According to one embodiment, the material may be grey in color.

Figure 5A:
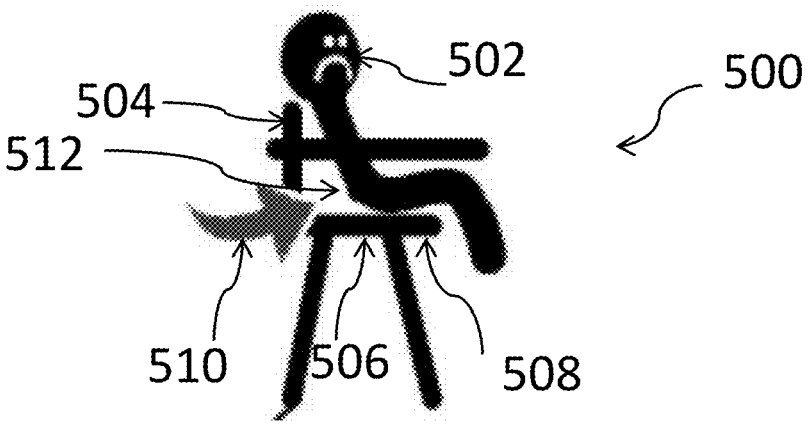
FIGS. 5A and 5B illustrate a before and after diagram showing exemplary results of the nonslip seat pad.
Figure 5B:
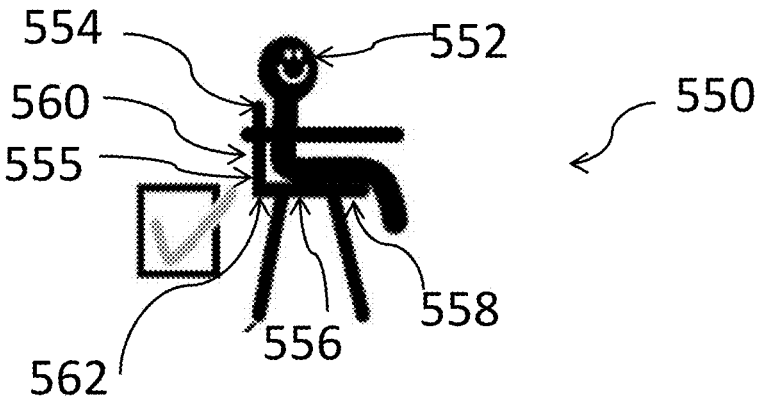

FIGS. 5A and 5B respectively illustrate a before and an after diagram showing results of the nonslip seat pad. In FIG. 5A, before the use of the nonslip seat pad, the configuration (500) of a subject (502) seated in a highchair (504) is depicted. In this configuration, the seat (506) of the highchair (504) may permit slipping, so that the buttocks of the subject (502) move in the forward direction (510), toward the front edge (508) of the seat (506) in a manner that promotes poor posture. The angle (512) of the subject's upper body to lower body tends toward an obtuse angle, which is sub-optimal. In this configuration, the subject may experience the following: a) a chance of choking on food and drink b) pressure on the back and tailbone; c) improper posture; and/or d) difficulty in breathing. In FIG. 5B, after the use of the nonslip seat pad, the configuration (550) of a subject (552) seated in a highchair (554) is depicted. In this configuration, the nonslip seat pad (555) is disposed on the seat (556) of the highchair (554) between the upper surface of the seat and the subject's buttocks. The nonslip seat pad has grip, and does not permit slipping, so that the buttocks of the subject (552) remain in the intended location, toward the back (560), of the chair, rather than slipping toward the front edge (558) of the seat (556). This promotes good posture. The angle (562) of the subject's upper body to lower body tends toward a right angle, which is optimal for a seated subject. After the use of the nonslip seat pad there may be the following: a) safer position when eating; b) keeps subject in upright position; c) improves posture at an early stage; and/or d) helps subject to breathe easier.

Figure 6A:
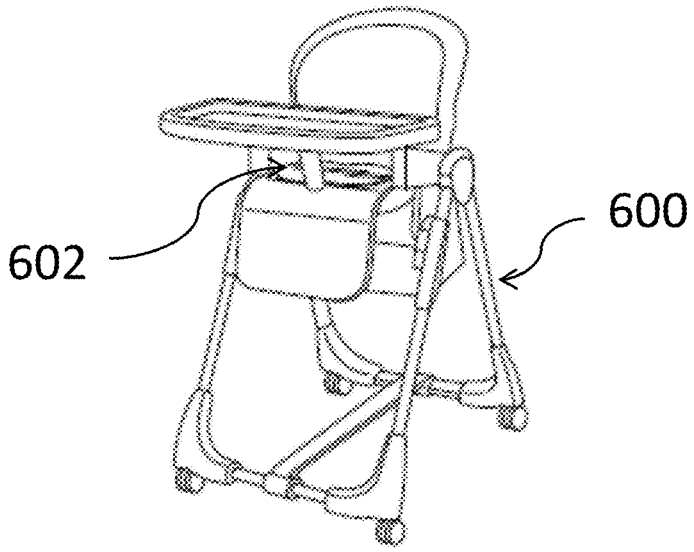
FIGS. 6A, 6B, 6C and 6D illustrate use of an embodiment of the nonslip seat pad.
Figure 6B:
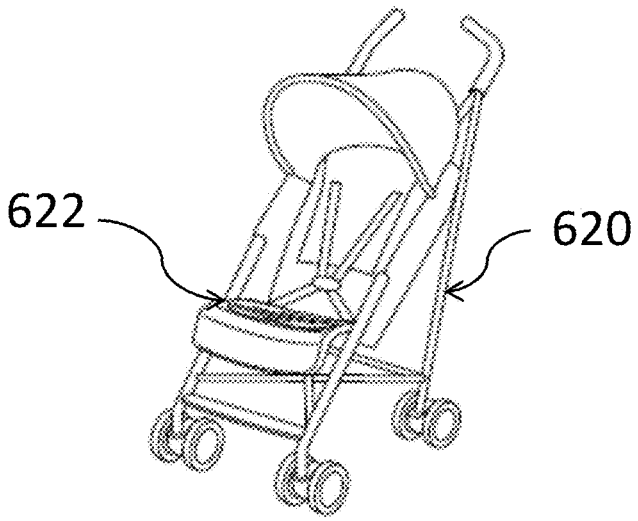
Figure 6C:
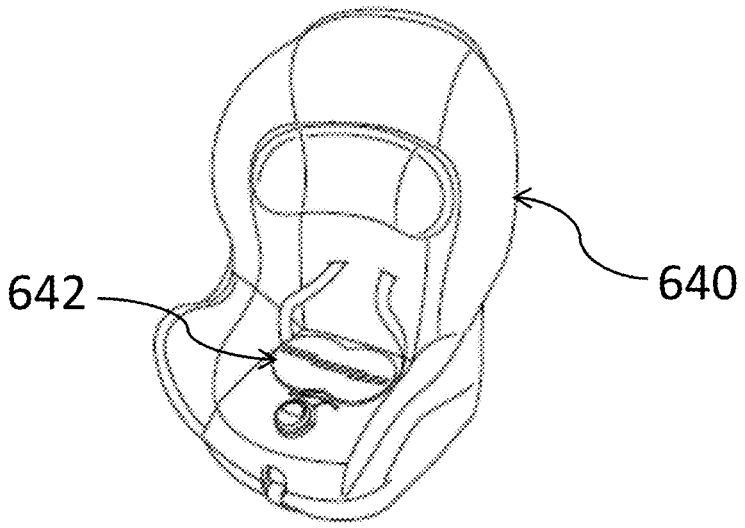
Figure 6D:
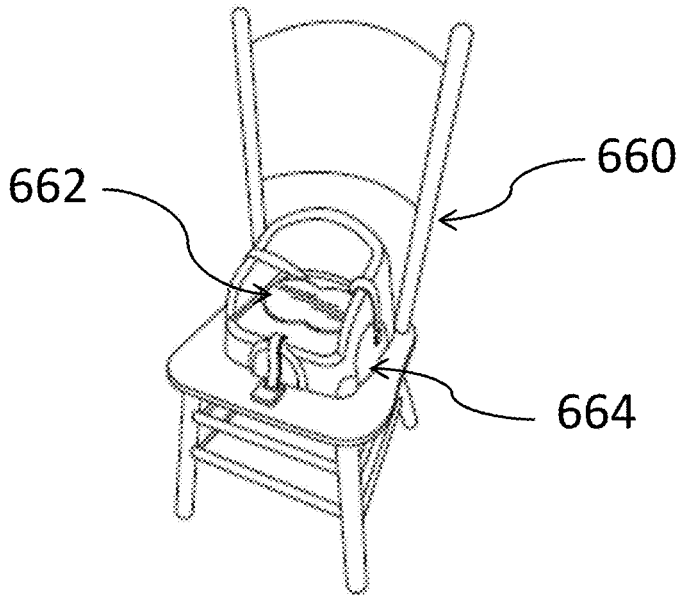

FIGS. 6A, 6B, 6C and 6D illustrate use of the nonslip seat pad on a highchair, stroller, car seat and booster seat. In FIG. 6A a highchair (600) is depicted with the nonslip seat pad (602) disposed upon the seat in the region where a child's buttocks would be situated when the highchair is in use. FIG. 6B depicts a stroller (620) with a nonslip seat pad (622) disposed upon the seat in the region where a child's buttocks would be situated when the stroller is in use. In FIG. 6C a car seat (640) is depicted with the nonslip seat pad (642) disposed upon the seat in the region where a child's buttocks would be situated when the car seat is in use. FIG. 6D depicts a chair (660) having a booster seat (664) strapped thereto, with a nonslip seat pad (662) disposed on the booster seat in the region where a child's buttocks would be situated when the booster seat (664) is in use.

There is described herein a nonslip seat pad for preventing a subject from sliding into an undesired seated position, said pad consisting of a gripping nonslip material configured in the shape of seated buttocks. Further, there is described herein a method of keeping a seated subject in an upright position comprising: positioning a nonslip seat pad on a seat to be sat upon by the subject, and seating the buttocks of the subject centrally upon the pad; said pad consisting of a gripping nonslip material configured in a shape of seated buttocks. Further, there is described herein a method of forming a nonslip seat pad comprising: slicing from a bun of gripping nonslip material, a sheet of about 3/32 inch thickness; and cutting the sheet into the shape of seated buttocks.

What is claimed is:

1. A nonslip seat pad for preventing a seated subject from sliding into an undesired seated position, said pad consisting of a single layer of a gripping, nonslip, and non-absorbent material configured in an oval shape with a waist formed by a central indentation along both longitudinal edges, wherein the pad has a length of substantially eight inches and a width of substantially six inches;

wherein said seat pad is flat and is of uninterrupted uniform thickness of about 3/32 inch.

2. The nonslip seat pad of claim 1, wherein the pad is re-usable, mobile, and non-adhesive.

3. A method of keeping a seated subject in an upright position comprising:

positioning a nonslip seat pad on a seat to be sat upon by the subject; and seating the buttocks of the subject centrally upon the pad;

said pad consisting of a single layer of a gripping, nonslip, and non-absorbent material configured in an oval shape with a waist formed by a central indentation along both longitudinal edges, wherein the pad has a length of substantially eight inches and a width of substantially six inches;

wherein said seat pad is flat and is of uninterrupted uniform thickness of about 3/32 inch; and wherein the subject is an infant or child and the seat upon which the pad is positioned is on a chair, highchair, stroller, walker, car seat, swing, teeter totter, spring toy, wagon, pull toy or play equipment.

4. The method of claim 3, wherein the nonslip seat pad is re-usable, mobile, and non-adhesive.

* * * * *